US005394593A

United States Patent [19]

Aoki

[11] Patent Number: 5,394,593

[45] Date of Patent: Mar. 7, 1995

[54] SLIDE-FASTENER COUPLING ELEMENT AND METHOD OF MAKING THE SAME

[75] Inventor: Toshio Aoki, Toyama, Japan

[73] Assignee: Yoshida Kogyo K.K., Tokyo, Japan

[21] Appl. No.: 181,913

[22] Filed: Jan. 18, 1994

[30] Foreign Application Priority Data

Jan. 29, 1993 [JP] Japan ..... 5-013283

[51] Int. Cl.[6] ..... A44B 19/00

[52] U.S. Cl. ..... 24/411; 24/409; 24/410

[58] Field of Search ..... 24/411, 409, 410, 412, 24/381, 388, 433, 435, 434

[56] References Cited

U.S. PATENT DOCUMENTS

| | | | |
|---|---|---|---|
| Re. 17,881 | 11/1930 | Winterhalter | 24/411 |
| 1,692,196 | 11/1928 | Blair | 24/411 |
| 2,047,925 | 7/1936 | Corner . | |
| 2,068,354 | 1/1937 | Seaver . | |
| 2,489,718 | 11/1949 | Morin | 24/410 |
| 2,628,400 | 2/1953 | Firing | 24/411 |
| 4,651,388 | 3/1987 | Horikawa et al. | 24/409 |

FOREIGN PATENT DOCUMENTS

| | | |
|---|---|---|
| 0064764 | 11/1982 | European Pat. Off. . |
| 0175198 | 3/1986 | European Pat. Off. . |
| 63-6295 | 9/1988 | Japan . |
| 1-22505 | 5/1989 | Japan . |

*Primary Examiner*—Victor N. Sakran
*Attorney, Agent, or Firm*—Hill, Steadman & Simpson

[57] ABSTRACT

A press-formed, metal, coupling element particularly suitable for use in a bidirectionally openable slide fastener which includes a coupling head portion having on its opposite end a protrusion and a corresponding pocket, and a guide groove formed in the front end of the coupling head portion, the guide groove having a width and a depth both reducing progressively from the pocket side toward the protrusion side of the coupling head portion. When the slide fastener is opened and closed, the guide groove in each coupling element slidably receives and guides the front end portion of the opposite coupling element as the protrusion and pocket of these coupling element are brought into and out of mutual engagement with each other. With the provision of the guide groove, the coupling elements are mutually engageable and disengageable with least friction resistance when the slide fastener is opened and closed in either of two reciprocal directions. A simple method of making such coupling element is also disclosed.

6 Claims, 5 Drawing Sheets

SLIDE-FASTENER COUPLING ELEMENT AND METHOD OF MAKING THE SAME

BACKGROUND OF THE INVENTION

1. Field of the Invention

The present invention relates to a press-formed, metal coupling element particularly suitable for use in a slide fastener which can be opened and closed in the forward direction and in the reverse direction by a pair of sliders mounted in either face-to-face or tail-to-tail confrontation on a pair of rows of discrete coupling elements, and a method of making such slide-fastener coupling element.

2. Description of the Prior Art

One known press-formed, metal coupling element for bidirectionally openable slide fasteners is disclosed in Japanese Utility Model Publication No. 1-22505. The disclosed coupling element includes a beveled side wall formed by pressing or stamping the front end of a coupling head portion. The beveled side wall generally slopes down from a protrusion side toward a pocket side of the coupling element so that the front end of each coupling element does not interfere with a protrusion of the opposite coupling element when the slide fastener is closed in the reverse direction.

The known coupling element may be made by a method or process disclosed in Japanese Patent Publication No. 63-6295 in which a metal wire that has been preformed into a Y profile is sliced into blank pieces which will become individual coupling elements, then a sliced blank piece is pushed into a head-forming station on a heading die where a protrusion and a corresponding pocket are formed by reciprocating a pocket punch toward the heading die. To transfer the blank piece into the head-forming station, a ram having a cutoff die and a cutoff punch are relatively moved with each other. Using this relative movement, the upper edge of the Y-shaped metal wire is partly compressed by a shaping shoulder of the cutoff punch so as to form a round corner edge which will extend around a pocket of the finished coupling element.

Since the beveled side wall of the known press-formed, metal coupling element slopes down from the pocket side toward the protrusion side, the opposed coupling elements are freely slidable in a perpendicular direction relative to the plane of engagement (viz. the plane of the slide fastener) immediately before they are engaged. In addition, since a guide channel formed in the slider has a height somewhat larger than the thickness of the individual coupling elements, the coupling elements of the construction previously mentioned tend to wobble within the slider. As a result. the coupling elements are coupled or interengaged insufficiently, and the movement of the sliders becomes sluggish and requires some muscle effort.

SUMMARY OF THE INVENTION

With the foregoing drawbacks of the prior art in view, it is an object of the present invention to provide a press-formed, metal, slide-fastener coupling element having structural features which make it possible to prevent the coupling element from slipping in a perpendicular direction relative to the plane of engagement immediately before and after it is engaged with the opposite coupling element, thereby ensuring that the coupling elements are mutually engageable smoothly and stably without causing slip or wobbling within the slider and with the resultant smooth sliding movement of the slider.

Another object of the present invention is to provide a simple method of making such slide-fastener coupling element.

In one aspect the present invention provides a slide-fastener coupling element which has a guide groove formed in the front end wall of a coupling head portion and opening away from opposed leg portions of the coupling element. The guide groove has a width reducing progressively in a direction from a pocket side toward a protrusion side of the coupling head portion.

Preferably, the depth of the guide groove reduces progressively toward the protrusion side of the coupling head portion.

The coupling element of the construction above described is particularly useful when embodied in a coupling element chain of a slide fastener which can be opened and closed either of two reciprocal directions by a pair of sliders mounted in either face-to-face or tail-to-tail confrontation on the coupling element chain.

As is generally known in the art, one problem associated with the conventional bidirectionally openable slide fastener is that while the slide fastener is smoothly operative with the slider moving in one or the forward diction, the operation becomes sluggish or otherwise defective when the slider is moved in the other or the reverse direction because of the interference between the coupling-element's protrusion on one stringer and the front end of the coupling element on the opposite stringer. In the case of the slide fastener using the coupling element of the present invention, the foregoing problem does not take place because when the slide fastener is closed, the guide groove in each coupling element on one stringer receives and guides the coupling head portion of the mating coupling element on the opposite stringer. The coupling elements are, therefore, mutually engageable with least frictional resistance even when the slider is moved in the reverse direction.

In another aspect the present invention provides a method of making the slide-fastener coupling element of the construction above described, which method comprises the steps of: providing a metal wire having a Y-shaped profile including a head portion and opposed leg portions, the metal wire further having a longitudinal groove extending in a surface which forms a front end of the head portion facing away from the leg portions; slicing off a blank piece of an individual product thickness from the Y-shaped metal wire by reciprocating a cutoff punch having a generally U-shaped cutting portion which is substantially complementary in shape with, and slightly smaller in size than, the contour of the head portion of the Y-shaped metal wire; and thereafter, pressing with a pocket punch the head portion of the blank piece from a surface which is formed by said slicing-off step in the preceding cycle, so that the pressed head portion is shaped into a coupling head portion having, on its opposite sides, a protrusion and a corresponding pocket, and the groove in the blank piece is shaped into a guide groove having a width reducing progressively in a direction from a pocket side toward a protrusion side of said coupling head portion.

The above and other objects, features and advantages of the present invention will become manifest to those versed in the art upon making reference to the detailed description and the accompanying sheets of drawings in which preferred structural embodiments incorporating the principle of the present invention are shown by way of illustrative example.

DETAILED DESCRIPTION OF THE INVENTION

Figure 1:
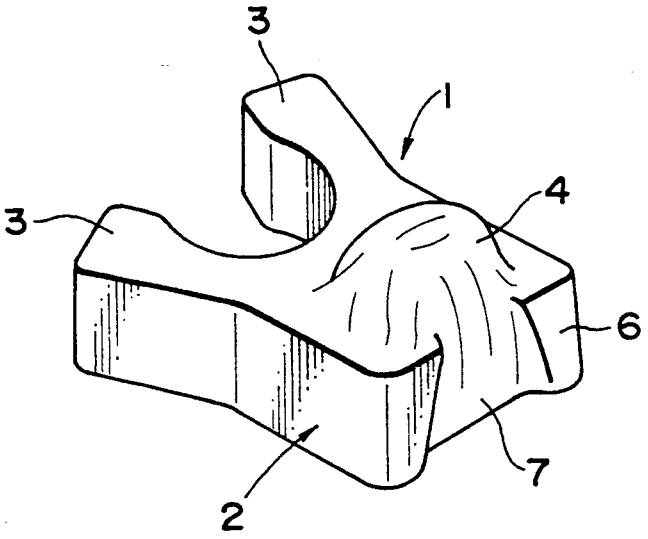
FIG. 1 is a perspective view of a coupling element according to one embodiment of the present invention.
Figure 2:
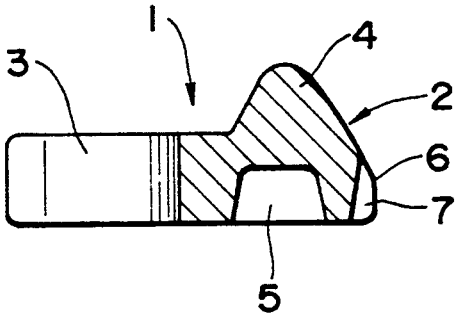
FIG. 2 is a vertical cross-sectional view of the coupling element.

Referring now to FIGS. 1 and 2, there is shown an individual slide-fastener coupling element 1 according to one embodiment of the present invention.

Figure 3:
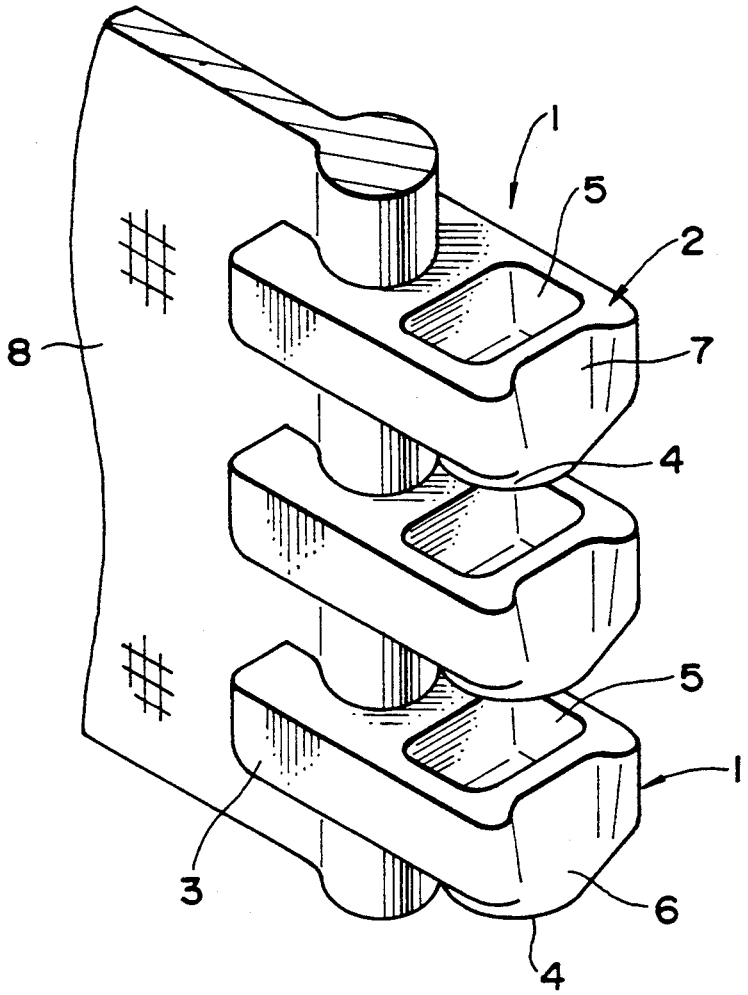
FIG. 3 is a perspective view of a slide fastener stringer having a row of coupling elements of the present invention.

The coupling element is made of metal and formed by a press. The press-formed, metal coupling element 1 is generally rectangular in shape and has a coupling head portion 2 and opposed leg portions 3 and 3 extending from an end (rear end) of the coupling head portion 2. The leg portions 3, 3 define therebetween a substantially oblong aperture (not designated) for receiving, as is well known, a longitudinal beaded edge of a stringer tape as shown in FIG. 3. The coupling head portion 2 has an engaging protrusion 4 on the top and a receiving pocket 5 (FIG. 2) on the bottom, the pocket 5 being complementary in shape with the contour of the protrusion 4 for receiving therein the protrusion 4 of the opposite coupling element when a slide fastener is closed.

According to one important feature of the present invention, the coupling head portion 2 has a vertical guide groove 7 formed in a front end wall 6 thereof and opening away from the leg portions 3 for guiding the coupling head portion 2 of the opposite coupling element. The guide groove 7 extends between the top and the bottom of the coupling head portion 2 across the height of the front end wall 6. The guide groove 7 has a width reducing progressively in a direction from the pocket 5 side toward the protrusion 4 side. The depth of the guide groove 7 also reduces progressively in a direction from the pocket 5 side toward the protrusion 4 side.

Figure 4:
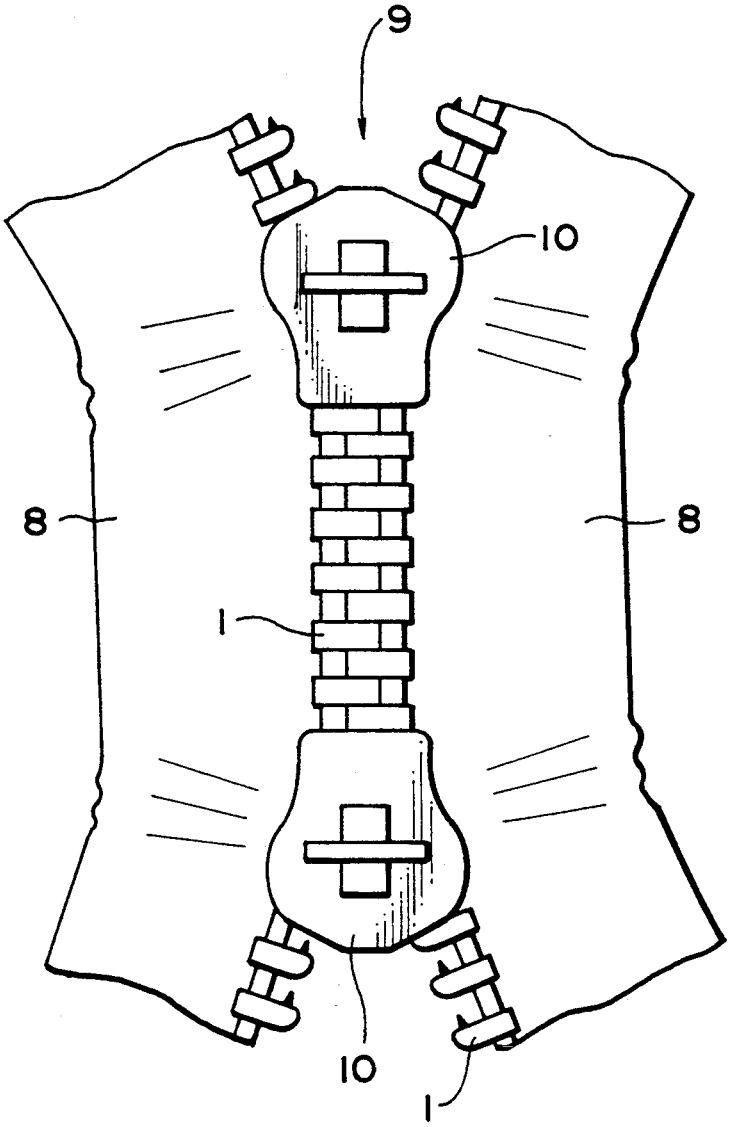
FIG 4 is a fragmentary plan view of a slide fastener tener which can be opened and closed in either of two reciprocal directions.
Figure 5:
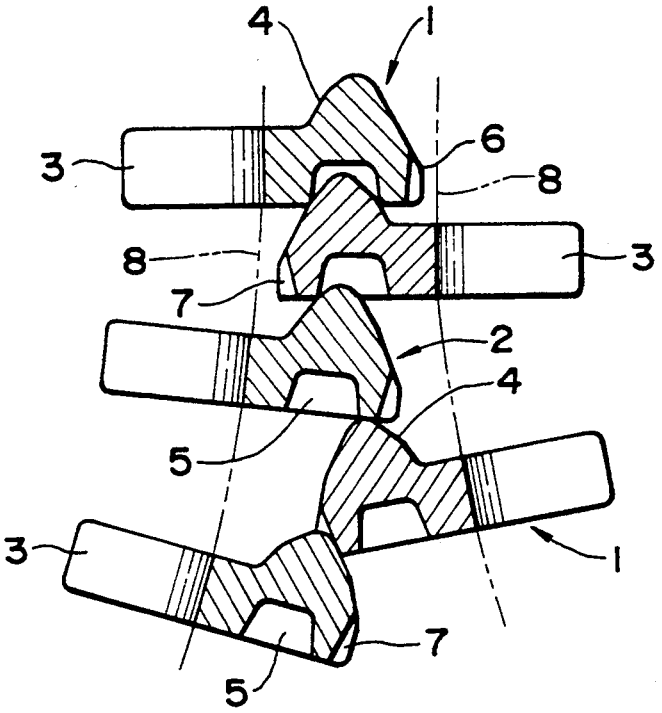
FIG. 5 is a diagrammatical cross-sectional view illustrative of the manner in which two rows of coupling elements of the invention are brought into interlocking engagement with each other.

A series of discrete coupling elements 1 of the construction above described are attached to a longitudinal beaded edge of a stringer tape 8 to form a slide fastener stringer, as shown in FIG. 3. Two such stringers are paired together to form a slide fastener which, as shown in FIG. 4, can be opened and closed in either of two reciprocal directions by a pair of sliders 10, 10′ slidably mounted in tail-to-tail confrontation on a coupling element chain 9 composed of two opposed rows of the coupling elements 1, 1. The sliders 10, 10′ may be mounted in face-to-face confrontation on the coupling element chin 9. The rows of coupling elements 1, 1 are coupled or interengaged in the manner as shown in FIG. 5. In this instance, the guide groove 7 in each coupling element 1 on one stringer tape 8 slidably receives and guides the front end portion of the mating coupling element 1 on the opposite stringer tape 8 as the protrusion 4 and the mating pocket 5 of the coupling elements 1 are fit with each other. With the element-guiding effect thus provided by the guide groove 7, the coupling elements 1 are mutually engageable smoothly without causing slip or wobbling relative to the plane of engagement. This is also true when the coupling elements 1 are disengaged. Accordingly, the coupling elements 1 are mutually engageable and disengageable smoothly and stably with least frictional resistance even when the slide fastener (FIG. 4) is closed and opened by the slider 10′ (FIG. 4).

Figure 6:
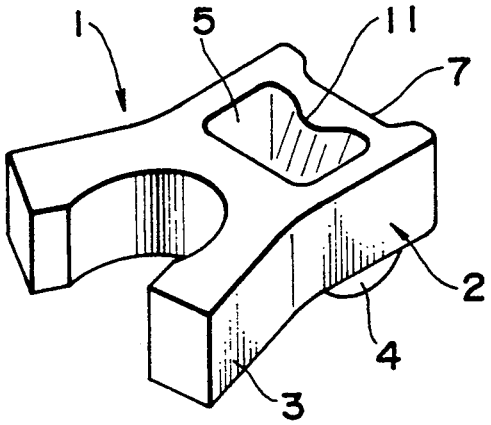
FIG. 6 is a perspective view of a coupling element according to another embodiment of the present invention.
Figure 7:
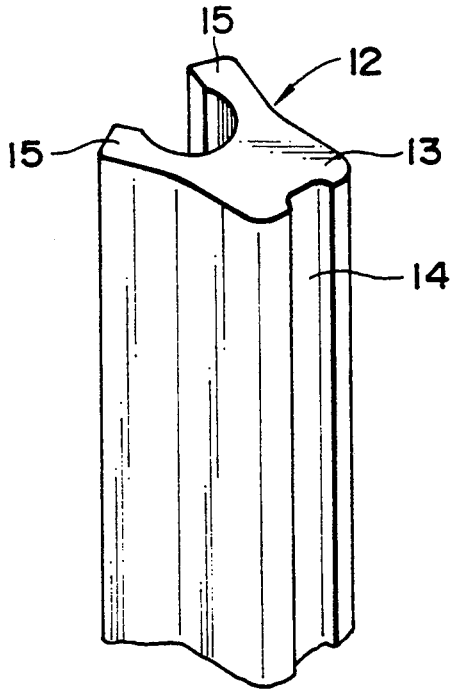
FIG. 7 is a perspective view of a generally Y-shaped metal wire used for producing a coupling element according to the present invention.

FIG. 6 shows a modified form of the coupling element according to the present invention. The modified coupling element 1 includes a round rib 11 projecting from the front wall of the pocket 5 and facing away from the front end wall 6 of the coupling head portion 2, the round rib 11 extending from an open end toward the bottom of the pocket 5. With the rib 11 thus provided, the coupling element 1 is able to pivot or turn about its projection 11 to some extent when a chain 9 (cf. FIG. 4) of the interengaged coupling elements 1 is subjected to a sudden vertical force or thrust tending to spread or rupture the coupling element chain 9.

The coupling elements 1 above described are most conveniently made by a method or process described below.

The process begins with a metal wire 12 that has been preformed into a Y profile including a substantially rectangular head portion 13 and two, somewhat diverging leg portions 15, 15 projecting from one end (rear end) of the square head 13. The Y-shaped metal wire 12 further has a longitudinal groove 14 extending in a surface which forms the opposite end (front end) of the head portion 13 facing away from the leg portions 15, 15. The width and depth of the groove 14 are constant throughout the length of the groove 14. The width of the groove 14 is slightly larger than the width of the guide groove 7 of the finished coupling element 1.

Figure 8:
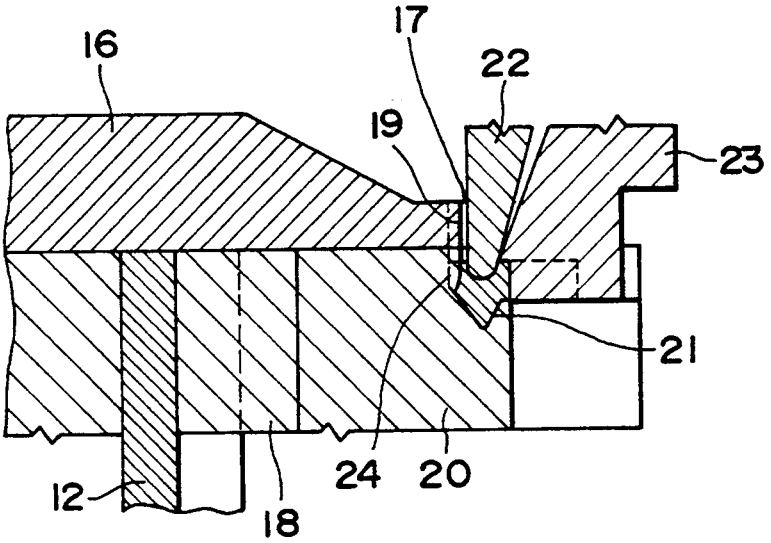
FIG. 8 is a vertical cross-sectional view showing a main portion of an apparatus used for carrying out a method of the present invention for making the coupling element shown in FIG. 1.

As the Y-shaped metal Wire 12 is moved upward in a machine shown in FIG. 8, a cutoff punch 16 is horizontally reciprocated relative to a cutoff die 18 to slice off a blank piece of an individual product thickness which will become individual coupling elements 1. The cutoff punch 16 has a substantially U-shaped cutting portion or blade 17 which is substantially complementary in shape with, and slightly smaller in size than, the contour of the head portion 13 of the Y-shaped metal wire 12. As a result of the slicing using the cutting portion 17, the groove 14 in a sliced blank piece is slightly reduced in width. The sliced blank piece is pushed by the cutoff punch 16 into a head-forming die 20 having a head-forming recess or cavity 21, the cavity 21 being complementary in shape with the contour of the protrusion 4 of the finished coupling element 1.

Then, a pocket punch 22 and an associated presser pad 23 are advanced downwardly toward the head-forming die 20 to press or stamp the head portion 13 of the blank piece from the upper surface which is formed or produced by the slicing-off step in the preceding cycle. Thus, the material of the head portion 13 of the sliced blank piece is forced by the pocket punch 22 to flow into the head-forming cavity 21 so that a coupling head portion 2 having, on its opposite sides, a protrusion 4 and a corresponding pocket 5 is formed. In this instance, the groove 14 in the sliced blank piece is shaped into a guide groove 7 whose width and depth reduce progressively toward the protrusion 4 side of the coupling head portion 2. Thus, the blank piece is shaped into a finished coupling element 1 of the construction shown in FIG. 1.

Thereafter, the pocket punch 22 and the presser pad 23 are retracted upwardly, after which the head-forming die 20 supporting thereon one finished coupling element 1 is advanced in the right-hand direction on FIG. 8 toward a slide fastener stringer tape (not shown) which is supported in a vertical orientation. The leg portions 3 of the finished coupling element 1 are clamped on a longitudinal beaded edge of the stringer tape by a clincher (not shown) and then the stringer tape advances upwardly. By repeating the foregoing operation, a single slide fastener stringer such as shown in FIG. 3 is produced.

As described above, the U-shaped cutting portion 17 of the cutoff punch 16 which is substantially complementary in shape with, but slightly smaller in size than, the contour of the head portion 13 of the Y-shaped metal wire 12. Accordingly, a blank piece, when it is sliced off from the Y-shaped metal wire 12 using the cutoff punch 16, the head portion 13 is slightly deformed or compressed such that the width of the entire head portion 13 and the width of the groove 17 are slightly reduced. The groove 17 of the thus compressed head portion 13 is substantially equal to the minimum width of the guide groove 7 in the finished coupling element 1. The groove 17 is spread at its upper side when the pocket punch 22 is reciprocated to press or stamp the head portion 13 of the sliced blank piece from the upper surface so as to form the pocket 5 and the corresponding protrusion 4. With this spreading, the groove 17 is shaped into a guide groove 7 which has a width reducing progressively from the pocket 5 side toward the protrusion 4 side of the coupling head portion 2.

To secure the final shape of the guide groove 7, the cutting portion 17 of the cutoff punch 16 may most preferably be provided with a vertical projection 19 (FIG. 8) which is complementary in shape with the groove 14 formed in the sliced blank piece. The projection 19 has a width substantially equal to the minimum width of the guide groove 7 of the finished coupling element 1. Similarly, the head-forming die 20 may most preferably be provided with a vertical projection 24 formed on the wall of the forming cavity 21 and having a shape complementary in contour to the shape of the guide groove 7 of the finished coupling element 1. That is, the projection 24 has a width and a depth that reduce progressively in a vertically downward direction. During the slicing-off step, the groove 14 in the head portion 13 is shaped to have the width of the projection 19. When the head portion 13 of the blank piece is pressed or stamped with the pocket punch 22, the projection 24 forcibly shapes the groove 14 of the blank piece to have the shape and configuration of the guide groove 7 of the finished coupling element 1.

When the coupling element 1 shown in FIG. 6 is to be produced, the pocket punch 22 shown in FIG. 8 is replaced with a different pocket punch (not shown) which is recessed at its front end wall so as to form a groove complementary in shape with the contour of the round rib 11 (FIG. 6) of the finished coupling element 1. By using the thus recessed pocket punch, the head portion 13 of a blank piece can readily be shaped into a head portion 3 having a round rib 11 such as shown in FIG. 6.

In brief, a method provided in accordance with the present invention for making the slide-fastener coupling element of the construction above described comprises the steps of: providing a metal wire having a Y-shaped profile including a head portion and opposed leg portions, the metal wire further having a longitudinal groove extending in a surface which forms a front end of the head portion facing away from the leg portions; slicing off a blank piece of an individual product thickness from the Y-shaped metal wire by reciprocating a cutoff punch having a cutting portion which is substantially complementary in shape with, and slightly smaller in size than, the contour of the head portion of the Y-shaped metal wire; and thereafter, pressing with a pocket punch the head portion of the blank piece from a surface which is formed by said slicing-off step in the preceding cycle, so that the pressed head portion is shaped into a coupling head portion having, on its opposite sides, a protrusion and a corresponding pocket, and the groove in the blank piece is shaped into a guide groove having a width reducing progressively in a direction from a pocket side toward a protrusion side of said coupling head portion.

As described above, the coupling element 1 has a guide groove 7 which is formed in the front end wall 6 of the coupling element 1 and which has a width reducing progressively in a direction from the pocket side toward the protrusion side of the coupling head 2. When two stringers are coupled or engaged together, the guide groove 7 in each coupling element 1 on one stringer slidably receives and guides the coupling head 2 of the mating coupling element 1 on the opposite stringer as the protrusion 4 and the mating pocket 5 are brought into mutual engagement with each other. By virtue of the guiding effect attained by the guide groove 7, opposed rows of coupling elements of the stringers can be smoothly and stably engaged together without causing vertical slip or wobbling relative to the plane of engagement. The slider is, therefore, movable smoothly. Owing to the shape of the guide groove 7, the coupling element 1 of the present invention is particularly useful when embodied in a slide fastener which can be opened in either of two reciprocal directions. Since the depth of the guide groove 7 reduces progressively toward the protrusion side, the coupling elements 1 of the slide fastener are mutually engageable and disengageable with least frictional resistance even when the slider is moved in the reverse direction.

As described above, the coupling-element making method of the invention begins with a metal wire 12 of a Y-shaped profile. The Y-shaped metal wire 12 has a longitudinal groove 14 extending in a surface which forms a front end of the head portion 13 of the Y profile facing away from the leg portions 15 of the Y profile. Then, the Y-shaped metal wire 12 is sliced off into blank pieces of individual product thickness by reciprocating a cutoff punch 16 having a cutting portion 17. Since the cutting portion 17 is substantially complementary in shape with, and slightly smaller in size than, the contour of the head portion 13 of said Y-shaped metal wire 12, the width of the groove 14 is slightly reduced. Thereafter, a pocket punch 22 is driven to press or stamp the head portion 13 of the blank piece from a surface which is formed by said slicing off step in the preceding cycle, so that the pressed head portion 13 of the blank piece is shaped into a coupling head portion 2 having, on its opposite sides, a protrusion 4 and a corresponding pocket, and the groove 17 in said blank piece is shaped into a guide groove 7 having a width reducing progressively in a direction from a pocket side toward a protrusion side of said coupling head portion 2. The method described above does not require an apparatus or press which is complicated in construction. Accordingly, the coupling element can be manufactured easily and less costly.

Obviously, various minor changes and modifications of the present invention are possible in the light of the above teaching. It is therefore to be understood that within the scope of the appended claims the invention may be practiced otherwise than as specifically described.

What is claimed is:

1. A slide-fastener coupling element which includes a coupling head portion and opposed leg portions extending from an end of said coupling head portion, said coupling head portion having, on its opposite sides, a protrusion and a corresponding pocket, said coupling head portion further having a front end wall facing away from said leg portions, and a guide groove formed in said front end wall and extending between a protrusion side and a pocket side of said coupling head portion, said guide groove having a width reducing progressively toward said protrusion side of said coupling head portion.

2. A slide-fastener coupling element according to claim 1, wherein said guide groove has a depth reducing progressively toward said protrusion side of said coupling head portion.

3. A slide-fastener coupling element according to claim 1 or 2, wherein said coupling head portion further including a round rib projecting from a front wall of said pocket and facing away from said front end wall of said coupling head portion.

4. A method of making the slide-fastener coupling element of claim 1, comprising the steps of:

a) providing a metal wire having a Y-shaped profile including a head portion and opposed leg portions, said metal wire further having a longitudinal groove extending in a surface which forms a front end of the head portion facing away from the leg portions;

b) slicing off a blank piece of an individual product thickness from said Y-shaped metal wire by reciprocating a cutoff punch; and c) thereafter, pressing with a pocket punch the head portion of said blank piece from a surface which is formed by said slicing off step in the preceding cycle, so that the pressed head portion is shaped into a coupling head portion having, on its opposite sides, a protrusion and a corresponding pocket, and the groove in said blank piece is shaped into a guide groove having a width reducing progressively in a direction from a pocket side toward a protrusion side of said coupling head portion.

5. A method according to claim 4, wherein said cutoff punch has a cutting portion which is substantially complementary in shape with, and slightly smaller in size than, the contour of the head portion of said Y-shaped metal wire.

6. A method according to claim 4, wherein during said slicing, the groove in the Y-shaped metal wire is guided by a first projection on said cutting portion of said cutoff punch, and during said pressing, the material of the head portion of said blank piece is forced by said pocket punch to flow into a head-forming cavity in a head-forming die while the groove in said blank piece is being guided by a second vertical projection projecting into said head-forming cavity in said head-forming die, said head-forming cavity being complementary in shape with the contour of the protrusion of said coupling head portion, said first vertical projection having a width substantially equal to the minimum width of the guide groove of said coupling head portion, said second vertical projection being complementary in shape with the contour of the guide groove of said coupling head portion.

* * * * *